US012789109B2

(12) United States Patent
Kukreja et al.

(10) Patent No.: US 12,789,109 B2
(45) Date of Patent: Nov. 10, 2026

(54) SYSTEM OF A TOY ASSEMBLY LINE FOR A TOY, TOY ASSEMBLY LINE AND TOY

(71) Applicant: MIN TOY PRIVATE LIMITED, Mumbai (IN)

(72) Inventors: Rishabh Manish Kukreja, Mumbai (IN); Vaishnavi Nambiar, Mumbai (IN); Sanjeet Shailesh Ramteke, Mumbai (IN); Sanchit Sunil Gujaran, Mumbai (IN)

(73) Assignee: MIN TOY PRIVATE LIMITED, Mumbai (IN)

( * ) Notice: Subject to any disclaimer, the term of this patent is extended or adjusted under 35 U.S.C. 154(b) by 191 days.

(21) Appl. No.: 18/723,783

(22) PCT Filed: Apr. 10, 2023

(86) PCT No.: PCT/IN2023/050348

§ 371 (c)(1),
(2) Date: Jun. 24, 2024

(87) PCT Pub. No.: WO2024/009314

PCT Pub. Date: Jan. 11, 2024

(65) Prior Publication Data

US 2025/0058246 A1 Feb. 20, 2025

(30) Foreign Application Priority Data

Jul. 5, 2022 (IN) ..... 202221038501

(51) Int. Cl.
*A63H 33/30* (2006.01)
*A63H 17/00* (2006.01)
(Continued)

(52) U.S. Cl.
CPC ..... *A63H 33/30* (2013.01); *A63H 17/002* (2013.01); *A63H 33/046* (2013.01); *A63H 33/062* (2013.01)

(58) Field of Classification Search
CPC .... A63H 17/00; A63H 17/002; A63H 23/005; A63H 27/001; A63H 33/30
See application file for complete search history.

(56) References Cited

U.S. PATENT DOCUMENTS 3,670,450 A * 6/1972 Morosawa ..... A63H 17/00 446/424
4,360,988 A * 11/1982 Schoenfield ..... A63H 33/30 446/469

(Continued)

*Primary Examiner* — Kurt Fernstrom
(74) *Attorney, Agent, or Firm* — John Rizvi; John Rizvi, P.A.—The Patent Professor ®

(57) ABSTRACT

The system of a toy assembly line for a toy comprising: an assembly line box and a toy that can be assembled on the said assembly line box, wherein said toy comprises a main part of the toy and one or more auxiliary parts of the toy, wherein said main part of the toy has one or more indents in particular positions on which corresponding auxiliary part of the toy is detachably attached, wherein auxiliary part of the toy is fastened to the main part of the toy by purely translatory motion; and said assembly line box comprises one or more sub-assembly stations comprising a slot on the top for a transport device, resting plate on the bottom and one or more linking devices for attachment of the auxiliary parts of the toy on the main part of the toy.

15 Claims, 6 Drawing Sheets

Figure 1:
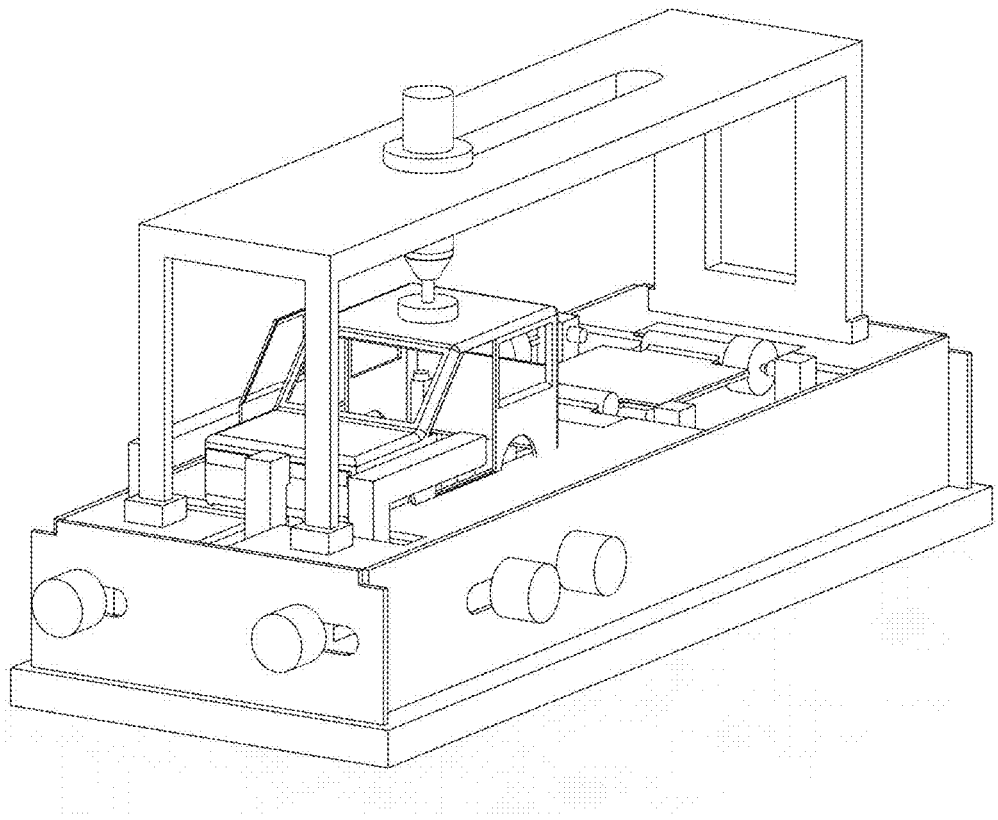

(51) Int. Cl.
*A63H 33/04* (2006.01)
*A63H 33/06* (2006.01)

(56) References Cited

U.S. PATENT DOCUMENTS

| | | | | |
|---|---|---|---|---|
| 10,646,787 | B2 | 5/2020 | Cheung | |
| 2007/0198117 | A1* | 8/2007 | Wajihuddin | A63H 17/002 700/114 |
| 2008/0143141 | A1* | 6/2008 | Ruslanov | A63H 17/262 296/181.1 |
| 2014/0113521 | A1* | 4/2014 | Davolt | A63H 33/046 446/92 |
| 2016/0107093 | A1 | 4/2016 | Cheung | |

* cited by examiner

SYSTEM OF A TOY ASSEMBLY LINE FOR A TOY, TOY ASSEMBLY LINE AND TOY

FIELD OF INVENTION

The present invention relates to children's educational toy system. The system comprises a toy assembly line and a toy. The toy assembly line assembles toy by joining various parts of the toy.

BACKGROUND ART

The motor skills of the children develop during the formative years. Accordingly, various educational toys are available in the market. The present invention deals with the idea that a toy is made up of various elements. The toy can be assembled from its parts. The concept of an assembly line is introduced to the children wherein different stages of assembly line incorporate different parts of the toy for assembly.

This is a new concept for a toy. Being a new variant of a DIY toy, the invention will be compared to conventional DIY toys. The similarities between the two are that in both products, unassembled components of a given toy are given to the consumer. The assembly of the given components forms a major part of the playing experience. However, the difference between the two is, while conventional DIY toys require one to assemble the components by hand, and sometimes with hand held tools, this invention mechanizes that process. The product contains a box, with several actuators made accessible to the user. These actuators are connected to links, on which the unassembled components need to be placed. Upon using the actuators as directed, these components will move from their starting position, and will come together to form the assembled product. The current example is of a toy vehicle. However, the same principle can be applied to a variety of toys, such as action figures and animals, which already exist in the conventional DIY format. Furthermore, the method of fastening in use currently is magnetic, but other methods of fastening, such as clip fitting, the stud and tube assembly, locks etc., can also be used with this concept.

The benefits of this invention over the conventional DIY toys come in the form of different as well as added utility. This new concept teaches its users how products are manufactured, instead of teaching them how to assemble the components themselves. While this requires less hand skill, it has immense potential as an educational toy, introducing children to manufacturing and automation. It also forces the user to visualize where each component will fit without actually fitting the components. It aims at improving a similar skill set, which includes spatial reasoning, visualization, and dexterity, but the added utility is in its role as an educational toy. It is essentially the toy of a factory, which introduces its users to mechanization, teaching them how man and machine interact. Its extensive use of links also gives its users a rudimentary idea of how moving something in one place can lead to a different object moving elsewhere. In addition, it provides the unique experience of having a toy of a functional factory, in which products can be assembled, and then used.

OBJECT OF INVENTION

The invention provides a system for toy assembly comprising a toy and an assembly line for assembling of the toy.

The invention proposes a toy assembly line with one or more sub-assembly stations.

The invention also proposes a toy such that the toy can be assembled in the said assembly line of the system.

SUMMARY OF INVENTION

The system of a toy assembly line for a toy comprising: an assembly line box and a toy that can be assembled on the said assembly line box, wherein said toy comprises a main part of the toy and one or more auxiliary parts of the toy, wherein said main part of the toy has one or more positional markers on which corresponding auxiliary part of the toy is detachably attached, wherein auxiliary part of the toy is fastened to the main part of the toy by purely translatory motion; and said assembly line box comprises one or more sub-assembly stations comprising a resting plate on the bottom for resting main component of the toy and one or more linking devices for attachment of the auxiliary parts of the toy on the main part of the toy, and for more than one sub-assembly stations it has a slot on the top for a transport device.

The toy for the said system comprising a main part of the toy and one or more auxiliary parts of the toy, wherein said main part of the toy has one or more positional markers on which corresponding auxiliary part of the toy is detachably attached, wherein auxiliary part of the toy is fastened to the main part of the toy by purely translatory motion.

The assembly line box for the said system comprising one or more sub-assembly stations comprising a resting plate on the bottom for resting main component of the toy and one or more linking devices for attachment of the auxiliary parts of the toy on the main part of the toy, and for more than one sub-assembly stations, it has a slot on the top for a transport device.

The present invention and its advantages will be better understood on studying the detailed description of an embodiment taken by way of non-limiting example and illustrated by the appended drawings in which:

BRIEF DESCRIPTION OF ACCOMPANYING DRAWINGS

Figure 2:
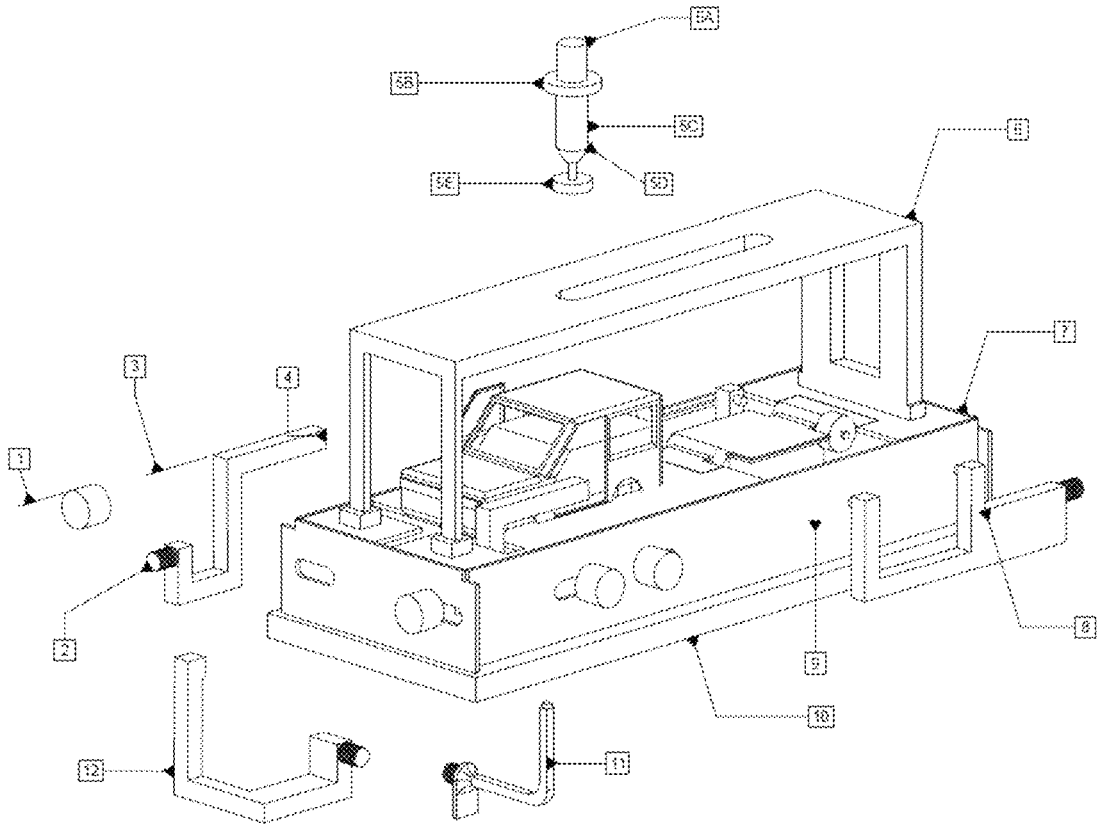
Figure 3:
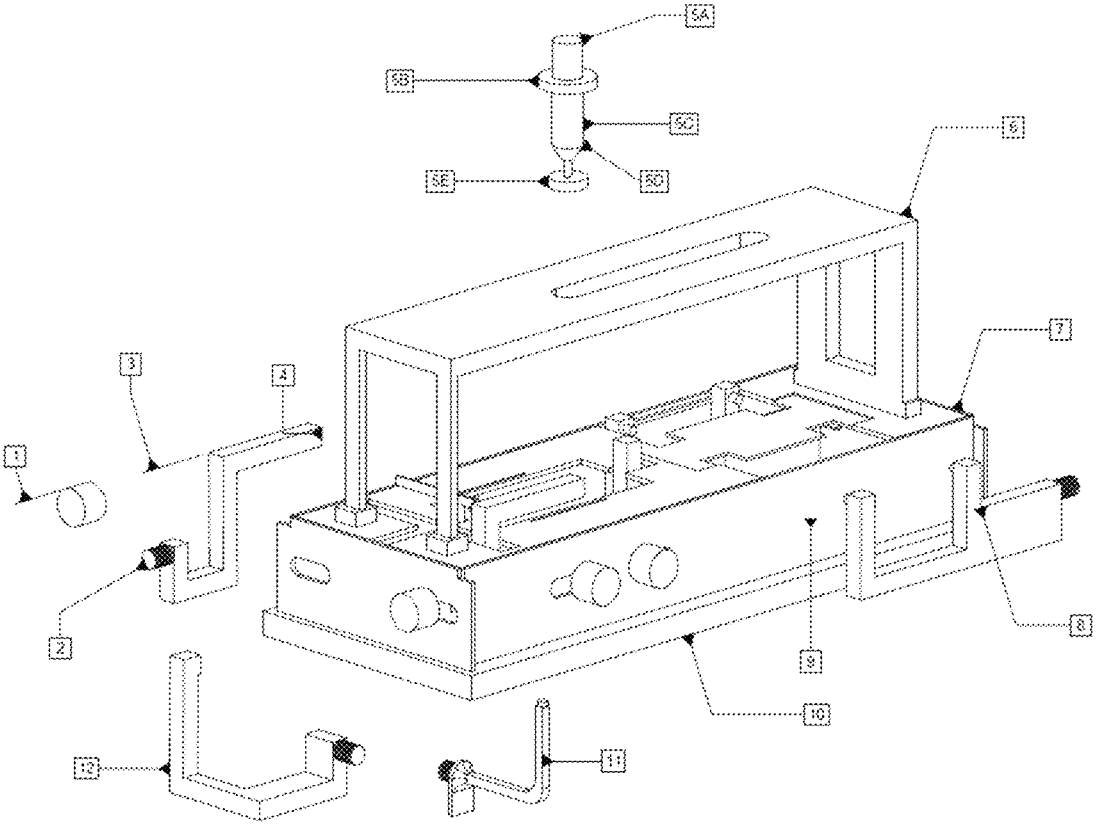
Figure 4:
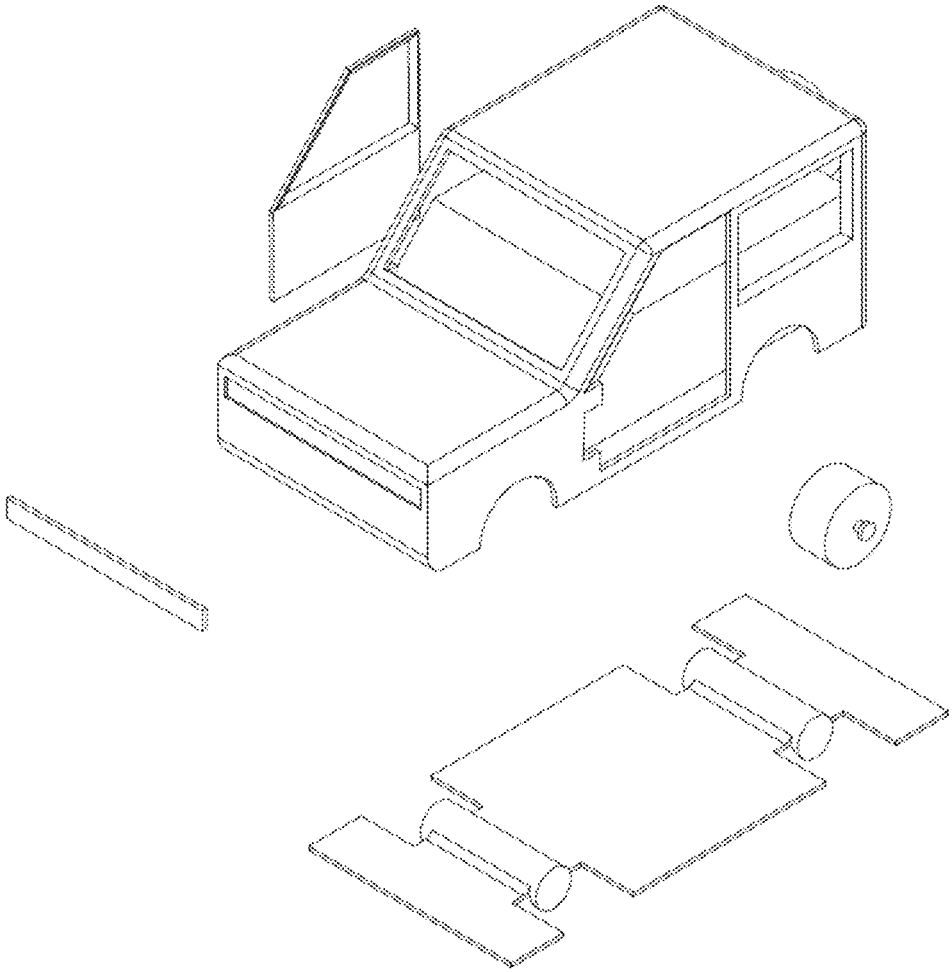
Figure 5:
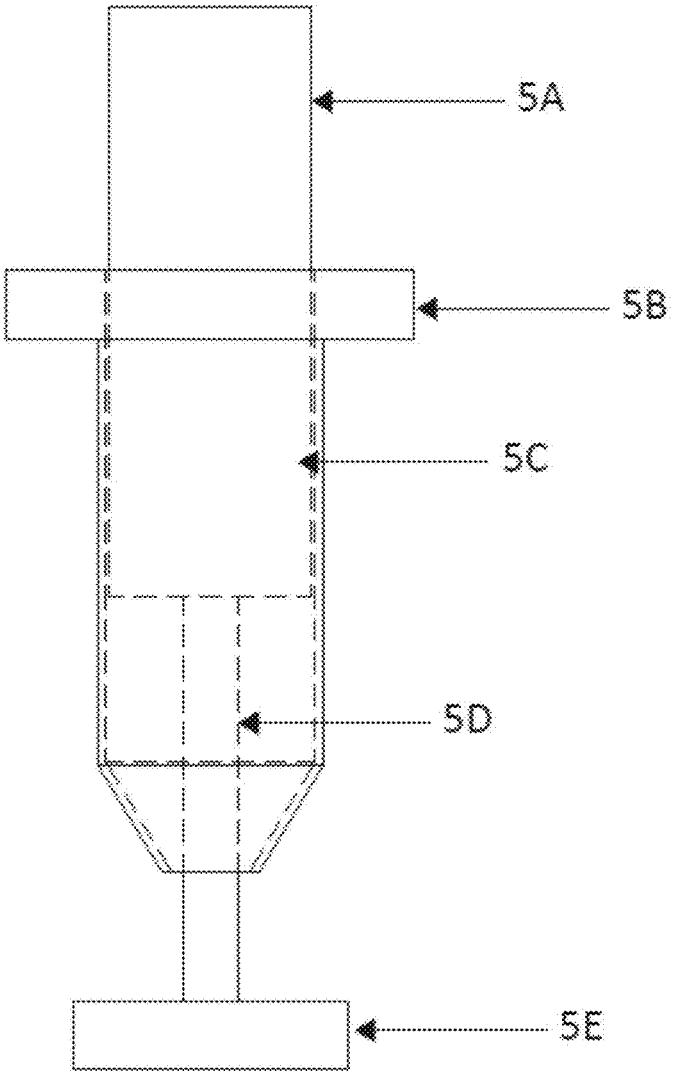
Figure 6:
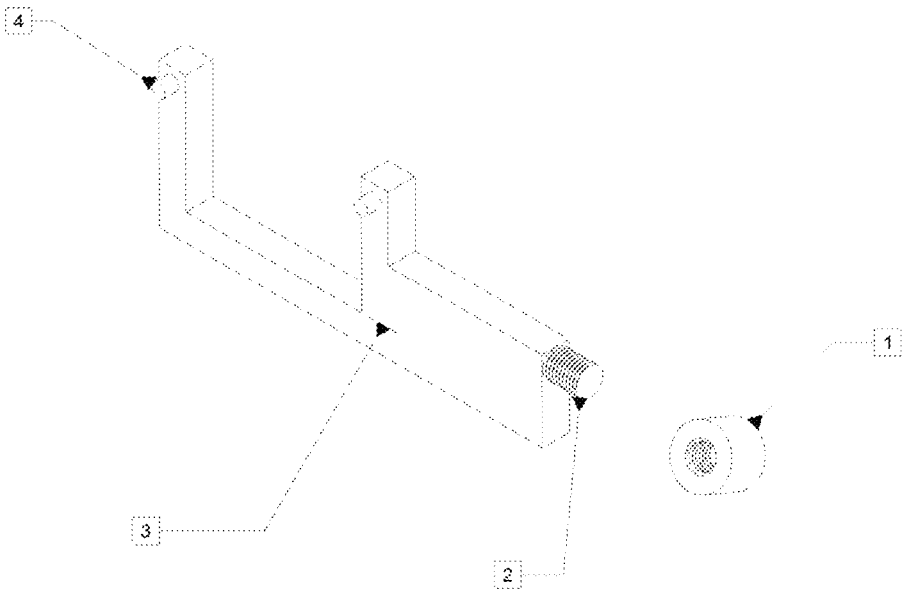

FIG. 1 discloses an assembled system of a toy assembly line for a toy;

FIG. 2 discloses an exploded view of the system;

FIG. 3 discloses an exploded view of the assembly line;

FIG. 4 discloses an exploded view of the toy;

FIG. 5 discloses transport device, also known as collection and delivery device; and FIG. 6 discloses an embodiment of linking device.

DETAILED DESCRIPTION

The invention is a new kind of toy. It loosely resembles a DIY, or Do-It-Yourself toy, the similarity being unassembled components of a finished toy are made available to the consumer. However, in this product, a part of the toy itself is dedicated to assembling the components, instead of the consumer assembling them by hand.

The system comprises of two main components: an assembly line box and a toy that can be assembled on the said assembly line box.

The toy comprises of various parts. The toy comprises of a main body of the toy and one or more auxiliary parts of the toy. The auxiliary parts of the toy are detachably attached or fastened to the main part of the toy. The location of the auxiliary parts of the toy is fixed. The main part of the toy has particular positions on which the auxiliary parts of the toy are detachably attached or fastened.

One characteristic feature of said auxiliary parts is that the auxiliary part are detachably attached or fastened to the main part of the toy by purely translatory force.

This feature is achieved by the use of magnets, electromagnets, snapping means, buttons, buckles, clip fitting, the stud and tube assembly, locks or combination thereof.

The main part of the toy comprises one or more positional markers on which corresponding auxiliary parts of the toy are detachably attached by the assembly line.

In an embodiment, these positional markers are indented for better fastening of the auxiliary part of the toy to the main part of the toy.

The assembly line of the toy comprises primarily of an assembly line box. This assembly line comprises of one or more sub-assembly stations. The said sub-assembly stations can be linearly placed or placed in a grid like structure. One embodiment of the invention consists of the sub-assembly stations in a branched pattern wherein the main part of the toy is moved to different paths such that different types of auxiliary parts get detachably attached to the main part. At the end of every path, as different auxiliary parts are detachably attached to the main part, the assembled toy is different.

The resting plate comprises of slots and indents. The slots and indents are designed such that when transport device stops at the specified marker, the main device rests on particular position on the resting plate. This prevents the movement of the main part of the toy so that the auxiliary parts are attached at the correct position.

The linking device comprises of an actuator, a connector and an attachment plate. Every auxiliary part of the toy has its respective linking device on a particular sub-assembly station by which said auxiliary part of the toy gets detachably attached to the main part of the toy on particular position.

The actuator is a button shaped device that can be grabbed by hands and moved in two directions of one axis. The movement of actuator is limited by length of slots on the sub-assembly station where the linking device is positioned.

The actuator is attached to the connector such that the actuator moves in one axis and purely translatory force is applied to the connector. The connector is in turn attached to the attachment plate which moves in the same axis to that of the actuator. The distance covered by the attachment plate is equal to the distance covered by the actuator. The connector can be of different shapes and sizes depending upon the auxiliary part of the toy for which it is used.

The attachment plate is the device that assembles the auxiliary part of the toy from the assembly line to the main part of the toy.

When more than one sub-assembly stations are employed, the sub-assembly stations comprise a slot on the top for a transport device, resting plate on the bottom for resting main component of the toy and one or more linking devices for attachment of the auxiliary parts of the toy on the main part of the toy.

The slot on the top optionally has positional markers that mark where the transport device is stopped for particular sub-assembly station.

The main part of the toy is moved from one sub-assembly station to other sub-assembly station using the transport device. This device picks up the main part of the toy from the particular sub-assembly station and moves along the slots on the top of the assembly line. It stops on the positional marker on other sub-assembly station and puts down the main part of the toy on the resting plate of the other sub-assembly station.

The transport device is also known as collection and delivery device. It consists of an actuator, a spring, a support and an attachment plate. The attachment plate attaches to the main part of the toy and spring picks up the main part to be transported. The device uses press mechanism to pick up or put down the main part of the toy. The attachment plate attaches to the main part of the toy through magnets. In one embodiment, it is electromagnets.

In this device, the main part of the toy also needs to be held down in its position at each subassembly station, to facilitate the assembly process. To achieve this, a clip is preferably added to the mechanism. As long as the clip is engaged, it keeps the spring compressed and the main part of the toy in position. When the subassembly is complete, the clip is to be disengaged, and the spring will return to its natural length, elevating the assembly from its position, allowing it to be transported to the next station.

The toy is assembled by stopping on various sub-assembly stations where one or more auxiliary parts of the toy are detachably attached to the main part of the toy.

Many modifications may readily be contemplated by those skilled in the art to which the invention relates. Many further modifications may readily be contemplated. The description set out above is particularly applicable to high rate clarification applications. However, in conventional clarification where the upstream or downstream processes herein described are not used, the teachings according to the invention may have considerable merit and are also applicable. The specific embodiments described, therefore, should be taken as illustrative of the invention only and not as limiting its scope as defined herein.

Components LIST:

| Part Number | Part Name |
|---|---|
| 1 | Cap |
| 2 | Actuator |
| 3 | Connector |
| 4 | Attachment Plate |
| 5a | Actuator Attachment |
| 5b | Support |
| 5c | Connecting Rod |
| 5d | Spring |
| 5e | Plate |
| 6 | Top Plate |
| 7 | Resting Plate |
| 8 | Linking Device (type 1, wheel link) |
| 9 | Side plate |
| 10 | Base Plate |
| 11 | Linking Device (type 2, glass link) |
| 12 | Linking Device (type 3, bumper link, present for both front and rear bumpers) |

We claim:

1. System of a toy assembly line for a toy comprising: an assembly line box and a toy that can be assembled on the said assembly line box, wherein said toy comprises a main part of the toy and one or more auxiliary parts of the toy, wherein said main part of the toy has one or more positional markers on which corresponding auxiliary part of the toy is detachably attached, wherein the auxiliary part of the toy is fastened to the main part of the toy by purely translatory motion; and said assembly line box comprises one or more sub-assembly stations comprising resting plate on the bottom for resting main component of the toy, one or more linking devices for attachment of the auxiliary parts of the toy on the main part of the toy, wherein for more than one sub-assembly stations, the assembly line box has a slot on the top for a transport device for moving the main part of the toy from one sub-assembly station to other sub-assembly station.

2. The system as claimed in claim 1 wherein the auxiliary part of the toy is detachably attached to the main part of the toy by magnets, electro-magnets, snapping means, buttons, buckles, clip fitting, the stud and tube assembly, locks or combination thereof.

3. The system as claimed in claim 1 wherein the main part of the toy has indents at the positional markers.

4. The system as claimed in claim 1 wherein the slot on top has positional markers that mark where the transport device is stopped for particular sub-assembly station.

5. The system as claimed in claim 1 wherein the resting plate comprises of slots and indents such that the main device rests on particular position on the resting plate.

6. The system as claimed in claim 1 wherein the linking device comprises of an actuator, a connector and an attachment plate.

7. The system as claimed in claim 1 wherein the transport device consists of an actuator, a spring, a support and an attachment plate.

8. The system as claimed in claim 1, wherein the assembly line box comprises one or more sub-assembly stations comprising resting plate on the bottom for resting main component of the toy and one or more linking devices for attachment of the auxiliary parts of the toy on the main part of the toy, wherein for more than one sub-assembly stations, the assembly line box has a slot on the top for a transport device for moving the main part of the toy from one sub-assembly station to other sub-assembly station.

9. The system as claimed in claim 8, wherein the slot on top has positional markers that mark where the transport device is stopped for particular sub-assembly station.

10. The system as claimed in claim 8 wherein the resting plate comprises of slots and indents such that the main device rests on particular position on the resting plate.

11. The system as claimed in claim 8 wherein the linking device comprises of an actuator, a connector and an attachment plate.

12. The system as claimed in claim 8 wherein the transport device consists of an actuator, a spring, a support and an attachment plate.

13. The system as claimed in claim 1, wherein the toy comprises a main part of the toy and one or more auxiliary parts of the toy, wherein said main part of the toy has one or more positional markers on which corresponding auxiliary part of the toy is detachably attached, wherein auxiliary part of the toy is fastened to the main part of the toy by purely translatory motion.

14. The system as claimed in claim 13 wherein the auxiliary part of the toy is detachably attached to the main part of the toy by magnets, electro-magnets, snapping means, buttons, buckles, clip fitting, the stud and tube assembly, locks or combination thereof.

15. The system as claimed in claim 13 wherein the main part of the toy has indents at the positional markers.

* * * * *